United States Patent [19]

Erickson

[11] 4,171,475

[45] Oct. 16, 1979

[54] FLEXIBLE SWITCH CONTACT HAVING A PRECIOUS METAL CONTACT SURFACE

[75] Inventor: Norman B. Erickson, Des Plaines, Ill.

[73] Assignee: Norlin Industries, Inc., Lincolnwood, Ill.

[21] Appl. No.: 911,937

[22] Filed: Jun. 2, 1978

[51] Int. Cl.[2] ..... H01H 102; H01H 1/18

[52] U.S. Cl. ..... 200/241; 84/1.01; 84/DIG. 7; 200/262; 200/290

[58] Field of Search ..... 84/1.01, DIG. 7; 200/241, 242, 246, 262, 276, 272, 245, 290, 16 C, 5 B

[56] References Cited

U.S. PATENT DOCUMENTS

| | | | |
|---|---|---|---|
| 2,067,485 | 1/1937 | Gardner et al. | 200/241 X |
| 2,630,503 | 3/1953 | Larsen et al. | 200/276 X |
| 2,881,293 | 4/1959 | Erickson | 200/166 |
| 3,290,472 | 12/1966 | Savage | 200/262 |
| 4,072,834 | 2/1978 | Godfrey | 200/242 X |

*Primary Examiner*—Frederick R. Schmidt

*Attorney, Agent, or Firm*—Ronald J. Kransdorf; Jack Kail

[57] ABSTRACT

A switch mechanism designed to overcome the problem of electrical noise employs a compound movable contact assembly, including a coil spring member and a smooth-surfaced wire contact member mounted thereon. The flexing of the coil spring provides an advantageous rolling, wiping motion for the wire contact member, without the noise-producing electrical discontinuities associated with earlier mechanisms in which the coil spring itself made direct electrical contact.

6 Claims, 5 Drawing Figures

FLEXIBLE SWITCH CONTACT HAVING A PRECIOUS METAL CONTACT SURFACE

This invention relates generally to electrical switches, particularly those employed in the keyboards of electronic organs and other musical instruments.

BACKGROUND AND PRIOR ART

This invention is an improvement in the type of electronic musical instrument keyboard switch disclosed in U.S. Pat. Nos. 2,630,503 of Larsen and 2,881,293 of Erickson. In those prior art switch mechanisms a coil spring is employed as the movable switch contact member, and is flexed laterally relative to its long dimension to move it into electrical contact with one or more stiff wires or posts serving as the fixed contacts of the switch mechanism. Such use of a coil spring as a movable switch contact has some advantages. From a mechanical point of view, it provides a simple and inexpensive switch movement. One end of the spring is anchored to the frame of the switch mechanism, and the other end, by merely being left free to flex, provides the motion necessary to transfer the movable contact into and out of electrical engagement with the fixed contact or contacts. And the entire mechanism is compact enough to meet the volume constraints of a musical keyboard, which must accommodate large numbers of such switches in shoulder-to-shoulder relationship.

The prior art design also has advantages from an electrical point of view. In particular, the lateral flexing of a coil spring element into contact with a fixed wire or post caused the coil spring to wrap itself partially around the wire or post. As it did so, the individual turns of the coil spring would squirm and scuff abrasively across the surface of the wire or post. The resulting cleaning action would tend to prevent oxide or dirt build-up on the contacts, thus keeping contact resistance low and constant over the life of the switch. In the 1950's, when the Larsen and Erickson patent applications were filed, these switch mechanisms were probably adequate.

But the present day state of the electronic musical instrument art is more demanding. The availability of medium and large scale integrated circuits for special purposes has led to the extensive use of low voltage digital logic in electronic musical instruments. Such circuitry is less tolerant of electrical noise, such as the "hash" generated by the mechanical chattering of switch contacts. A jagged electrical waveform associated with a single closing or opening or the contacts may be difficult to distinguish from a rapid sequence of multiple closings or openings.

For two fundamental reasons, a movable switch contact element formed of a coil spring is prone to produce such electrical noise. The first reason has to do with the fact that small but rapid changes in energy storage conditions apparently take place in the spring itself during actuation, and this inherent "liveliness" of the spring keeps it from being dimensionally stable on a short time scale. The individual coils of the spring seem alternately to bind against, and then abruptly release and skid across, the surface of the fixed contact member, as the tension in the coil spring changes during actuation of the spring mechanism. This abrupt motion causes contact chatter, which results in electrical noise.

The second reason has to do with the inherently rough external configuration which a coil spring has, owing to the fact that consists of an array of individual coils. Even if it were possible, as the coil spring is wrapped around the fixed contact, for each coil to be laid down and picked up smoothly without the skidding and chattering described above, still there would be successive quantum jumps in the amount of contact area as the individual coils came into or out of contact. This effect alone is sufficient to produce discontinuities in the electrical waveform during switch operation.

BRIEF SUMMARY OF THE INVENTION

The present invention aims at minimizing the problem of electrical noise, while retaining both the mechanical and electrical advantages of the coil spring switch mechanism described above. The basic prior art concept of coil spring flexure as a mechanical means of providing contact mobility is retained, but here the coil spring is used merely as a carrier element in a movable contact assembly. The actual contact element in this assembly is formed of a relatively stiff, smooth-surfaced member, such as a straight length of stiff wire, instead of a flexible, ridged element such as a coil. This type of contact member effects a smooth and continuous contacting motion instead of a chattering, discontinuous one. Nevertheless it has been found, quite serendipitously, that the flexibility of the coil spring carrier member imparts to the contact wire a unique rolling and wiping motion which retains much of the surface cleaning effect of the prior art mechanism. This and other features of the invention will now be described in detail, in connection with the following drawings.

DETAILED DESCRIPTION OF THE PREFERRED EMBODIMENT

Figures 1, 2, 3, 4, 5:
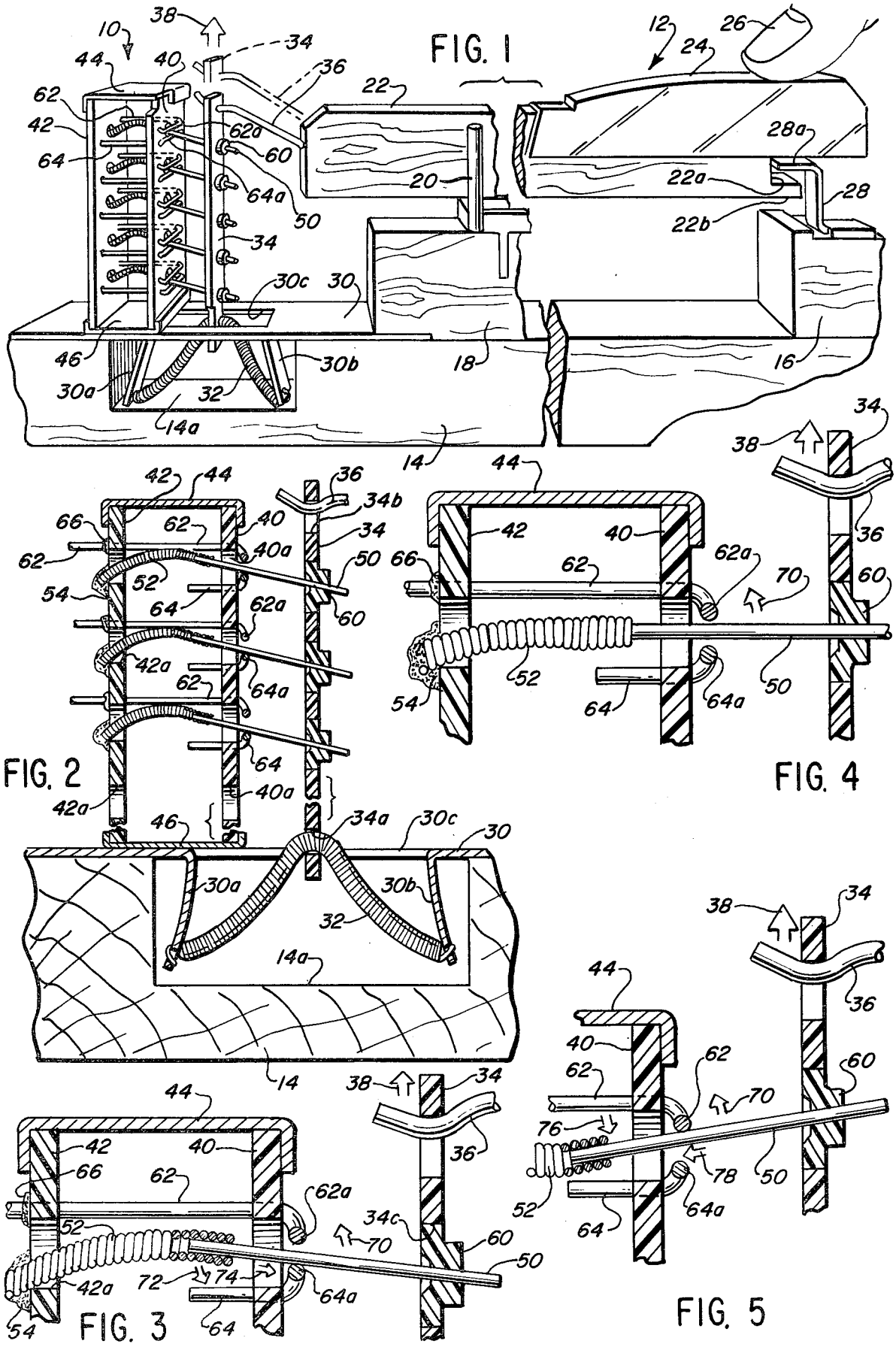
FIG. 1 is a perspective view, with selected parts duplicated in phantom lines to show motion, of a conventional musical key and an associated electrical switch mechanism in accordance with this invention.
FIG. 2 is an enlarged elevational view, with parts sectioned, of the switch mechanism of FIG. 1.
FIGS. 3, 4 and 5 are still further enlarged elevational views, with parts sectioned, of portions of the same switch mechanism, seen at three successive stages of its operation.

FIG. 1 illustrates both a switch mechanism 10 in accordance with this invention, and a conventional musical instrument key 12 to which it responds. Both are supported upon a base 14, the key mechanism 12 being raised above the base 14 by a front supporting block 16 and a rear supporting block 18. Upon the latter block is a U-shaped molded cradle 20 (only one side of which is visible in the drawing) within which loosely rests a key bar 22. The upstanding arms of the U-shaped cradle 20 serve to restrain the key bar 22 laterally, and the central, lower portion of the "U" serves as a fulcrum upon which the key 12 rocks when alternately depressed and released by a musician playing an instrument which incorporates the switch 10 and key 12.

Atop the key bar 22 is a key cap 24 of white or black material which is the accessible portion of a key mechanism on the keyboard of the instrument. The finger 26 of the musician presses down upon the key cap 24 as shown to depress the key. The key cap 24 and the forward end of the key bar 22 then move downwardly, while the key bar rotates, clockwise as viewed in the drawings, about the fulcrum formed by the cradle 20.

This motion of the key bar is limited by contact with the top of an upstanding lug 28 mounted on the forward supporting block 16.

Upon release of the key by the musician's finger 26, the key is returned to its initial position by a spring mechanism stored within a cut-out 14*a* formed in the base 14. As seen in FIGS. 1 and 2, a metal strip 30 is secured to the top of base 14 and extends rearwardly from the rear supporting block 18, bridging over the cut-out 14*a*. Two tongues 30*a* and 30*b* are struck downwardly from the strip 30 and into the interior of the cut-out 14*a* to form spring anchoring lugs. This leaves an upper window 30*c* formed in the bridging strip 30 to provide access to the cut-out 14*a*. The return spring for the key mechanism 12 is a length of coil spring 32 which is stored within the cut-out 14*a*, and has its opposite ends hooked into small holes punched in the anchoring lugs 30*a* and 30*b* respectively, thus securing the ends of the return spring 32 to the base 14. The intermediate portion of the return spring 32 is suspended within the cut-out 14*a* by a vertically oriented switch actuator member 34. The lower end of the actuator member depends through the window 30*c* into the cutout 14*a* and has an opening 34*a* formed therein through which the body of the coil spring 32 passes, in order to secure the spring to the actuator 34. The actuator depends from a hook 36 which extends rearwardly from the rear of the key bar 22, and hooks through an opening 34*b* formed in the upper end of the actuator 34.

During depression of the key cap 24 by the musician, rotation of the key bar 22 about the fulcrum provided by the cradle 20 causes the rear end of the key bar 22 to rise, thus lifting the hook 36 and the switch actuator 34 as indicated by the arrow 38 and the phantom lines in FIG. 1. The raising of the actuator 34 tenses the coil spring 32 against its anchoring lugs 30*a* and 30*b*. Then, when the key is later released, the spring 32 pulls down on the actuator 34 and hook 36, rotating the key bar 22 counter-clockwise back to its original position. This return motion of the key bar is limited by a bent-over tab 28*a* formed at the top of the limiting lug 28. The tab 28*a* is received within an opening 22*a* formed in the front of the key bar 22, and hooks over a lip 22*b* which projects forwardly from the key bar. When the lip 22*b* comes upwardly into contact with the underside of the tab 28*a*, the return motion of the key mechanism is complete.

In accordance with this invention, the switch mechanism 10 includes the switch actuator 34, which was described above in connection with the key mechanism 12, and a rectangular frame which includes front and rear upstanding frame members 40 and 42 respectively, and upper and lower frame members 44 and 46 respectively. Mounted on this frame are a plurality of identical switches, each of the single pole, double throw type, which are ganged for simultaneous operation in response to manual actuation and release of the musical key mechanism 12.

Each of the switches includes a movable switch contact assembly formed of a length of relatively stiff, smooth-surfaced contact wire 50, and a contact carrier member formed of a length of flexible coiled wire spring 52. The rear end of each movable contact wire 50 is received within the interior of its associated coil spring carrier 52 at the front end thereof, and the two are preferably secured together by laser welding, resistance welding, or mechanized crimping. The rear end of each coil spring carrier member 52 passes through one of several openings 42*a* formed in the rear member 42, and is affixed to the rear frame member by a blob of solder 54 deposited on the rear surface of the frame member. This solder assembly technique serves to secure the rear end of the movable contact assembly to the frame, and also provides a convenient method of achieving an external electrical connection to the movable contact assembly. Thus, an external wire (not shown) connected to the solder blob 54 is in electrical communication with the movable contact wire 50 through the coil spring 52.

Each coil spring 52 and its contact wire 50 extend generally forward from the rear frame member 42, while each contact wire 50 projects forwardly through an oversized opening 40*a* formed in the front frame member 40. The inherent flexibility of the coil spring carrier members 52, and the size of the front frame member openings 40*a*, permit the contact wires 50 to move in any direction transverse to the longitudinal axis of the coil spring 52. The vertical component of that degree of freedom is the motion which makes and breaks electrical contact in this switch mechanism. The forward end of each movable contact wire 50 is closely received within an opening formed in one of several coupling inserts 60. The latter in turn are mounted within suitable openings 34*c* (see FIG. 3) formed in the switch actuator member 34. As a result, the movable contact wires 50 are coupled to the switch actuator 34 for upward and downward motion therewith then the key mechanism 12 is actuated and released as described above. The upward motion of each movable contact wire 50 during key actuation brings it into electrical contact with an upper fixed contact wire 62, and at the same time lifts it out of electrical contact with a lower fixed contact wire 64. Thus during key actuation, each single pole, double throw switch breaks the lower contacts and makes the upper contacts. During key release the reverse is true.

In the illustrated embodiment, each fixed contact 62 and 64 is part of only one single pole, double throw switch assembly. In that case, each contact 62 and 64 is formed of a length of stiff wire bent into a shape approximating the letter J. As seen in FIG. 1, for each upper fixed contact wire 62 the long arm of the J shape originates behind the rear fram member 42, and passes through an opening in the rear frame member just above, and to the right of, its associated coil spring movable contact carrier member 52. From there it extends forwardly through an opening in the forward frame member 40, and then bends laterally across the front surface of the forward frame member to form the cross-bar 62*a* of the "J" shape. This cross-bar 62*a* passes from right to left across, and a short distance above, its associated movable contact wire 50 (when the key mechanism 12 is not actuated). The cross-bar then bends back once again to form the short arm of the "J," which passes through an opening in the forward frame member, above and to the left of the associated movable contact wire 50. The short arm of the "J" then extends a short distance rearwardly of the front frame member 40, and terminates.

All of the openings in the frame members 40 and 42 through which the fixed contact wires 62 pass are sized for a tight fit, so as to retain the contact wires in assembly therewith. In addition, a blob of solder 66 on the back surface of the rear frame member 42 surrounds each fixed contact wire 62 to help retain the latter in place, and also to facilitate external electrical connection thereto.

The lower fixed contact wires 64 are similarly arranged, except that the long arm of each "J" shape is situated below and to the left of the associated coil spring carrier member 52, the cross-bar 64*a* of the "J" is located below the associated movable contact wire 52 as it extends across the front surface of the front frame member 40, and the short arm of the "J" re-enters the frame member below and to the right of its movable contact wire 52.

The front and rear frame members 40 and 42 are both made in electrically insulating material to provide mutual electrical isolation among all the various fixed contact wires 62 and 64 and the movable contact carrier coil springs 52.

Each of the contact wires 62 and 64 could be a bus bar which extends across, and is electrically associated with, not just one but a plurality of single pole, double throw switch assemblies, i.e., the one illustrated herein, which is associated with a particular key 12 of the keyboard, plus a large number of other and similar switch assemblies, all arranged in shoulder-to-shoulder relationship with each other, and associated with other keys extending across the entire keyboard.

As a result of the preceding structural description, it will be appreciated that, as the movable contact wires 50 are moved up or down by the switch actuator 34, they move upwardly or downwardly into contact with the cross-bar portions 62*a* and 64*a* of their respective fixed contact wires 62 above or 64 below. Thus the cross-bar portions 62*a* and 64*a*, located immediately in front of the frame member 40, serve to make alternate electrical contact with their respective movable contact wires 50. In addition, these cross-bars 62*a* and 64*a* serve to define the upper and lower limits of the physical travel of the movable contact wires 50 during operation of the switch mechanism 10.

It is good practice to fashion the contact wires 50, 62 and 64 of solid gold or, less expensively, gold-clad or gold-plated wire to avoid the electrical problems associated with contact corrosion. However, it will now be explained in detail how the operation of the switch mechanism 10 helps considerably with the problem of contact cleanliness regardless of the choice of contact material.

The operation of the switch mechanism 10 will now be described in connection with FIGS. 2 through 5. FIG. 2 shows the position of the movable switch contact assembly 50, 52 when the key mechanism 12 is at rest, i.e., when the return spring 32 has drawn the switch actuator 34 down to the lower limit of its travel. Under these conditions, the actuator 34 holds the movable contact wires 50 down out of contact with their respective upper fixed contact wire cross-bars 62*a*, and in contact with their respective lower fixed contact wire cross-bars 64*a*. Thus, in the rest condition, the lower contacts are "made" and the upper contacts "broken."

Moreover, in the rest position the movable switch contact wires 50 are each drawn down somewhat below their points of initial contact with their respective lower fixed contact wire cross-bars 64*a*. As a result, the movable contact wires 50 have been rotated (clockwise as seen in FIG. 2) about the fulcrums provided by their respective lower cross-bars 64*a*, causing the rear end of each movable contact wire 50, i.e., the part which is received within it associated coil spring carrier 52, to be driven upwardly a sufficient distance to arch each of the coil springs 52 upward as seen in FIG. 1. This arched configuration which the coil springs 52 are forced to assume causes them to retract slightly in the longitudinal direction, since any curved line is longer than it straight line chord. The fit between the movable contact wires 50 and their respective coupling inserts 60 is loose enough to permit the movable contact wires 50 to be retracted slightly to the rear (i.e., toward rear frame member 42) due to the described retraction of the coil springs 52 to which they are secured.

Prior to actuation of the key mechanism 12, therefore, each movable contact wire 50 is held firmly down against its associated fixed contact cross-bar 64*a*, and is rotated somewhat thereabout, and is retracted slightly toward the rear. That is the condition depicted in FIG. 2. FIG. 3 shows what happens as the hook 36 and actuator 34 begin to rise, as shown by arrow 38, in the first phase of actuation of the key mechanism 12. Each coupling insert 60 raises the forward end of its associated movable contact wire 50, as indicated by the arrow 70. At this point the contact wire 50 has not been lifted sufficiently to break contact with the lower fixed contact cross-bar 64*a*. But it has been lifted enough to rotate counter-clockwise about the fulcrum provided by the cross-bar 64*a*, thus somewhat lowering the rear end of movable contact wire 50 as indicated by the arrow 72. This motion allows the carrier coil spring 52 to relax somewhat from its arched configuration, and in straightening out it projects somewhat forwardly as indicated by the arrow 74. This in turn slides the movable contact wire 50 a short distance forwardly in the direction of arrow 74 relative to the fixed contact cross-bar 64*a*. Thus we see that as the movable contact wire 50 rises toward lift-off from the lower fixed contact cross-bar 64*a*, it engages in a compound motion including both a rotational component which causes the movable contact wire 50 to roll counter-clockwise over the rounded surface of the cross-bar 64*a*, and also a translational component which causes the wire 50 to slide smoothly across an ever-changing point of tangency with cross-bar 64*a*. This compound motion creates a highly desireable rolling, sliding wiping action which maintains contact cleanliness and thus reduces electrical noise.

As seen in FIG. 4, eventually the rising motion of actuator 34 (see arrow 38) lifts the movable contact wire 50 entirely out of contact with the lower cross-bar 64*a*, thus breaking the lower electrical circuit. At this point the movable contact wire 50 is suspended between the carrier coil spring 52 and the coupling insert 60, and is out of contact with either of the fixed contact cross-bars 62*a* and 64*a*. The carrier coil spring 52 is relatively straightened at this stage of operation.

Further rising motion of the actuator 34 (see arrow 38) produces the condition depicted in FIG. 5. The continuing rise of the movable contact wire 50 brings it into engagement with the upper fixed contact cross-bar 62*a*. Such contact occurs, however, somewhat before the rise of the actuator 34 terminates. Therefore, as the actuator 34 continues to rise beyond the point of initial engagement of wire 50 and cross-bar 62*a*, the wire 50 is forced to rotate counter-clockwise about the fulcrum provided by the cross-bar 62*a*. This causes the rear end of the wire 50, the portion that is received within the carrier coil spring 52, to be driven downwardly as indicated by the arrow 76. As a result, the coil spring 52 is forced to assume a downwardly arched configuration, as illustrated in FIG. 5. The resulting slight retraction of the coil spring 52 then draws the wire 50 rearwardly across the cross-bar 62*a* (see arrow 78) as it is pressed upwardly into contact therewith. Thus, as electrical contact is made at the upper cross-bar 62*a*, a reverse version of the compound motion described above occurs: as members 50 and 62*a* are pressed into engagement, member 50 also rolls over and at the same time slides smoothly across an ever-changing point of tangency with member 62*a* to produce an effective contact-wiping action.

When the key mechanism 12 is released, actuator 34 is lowered to its initial position and the entire process is repeated in reverse. First wire 50 is disengaged from upper cross-bar 62*a*, with the same compound wiping action that was described earlier in relation to the disengagement of members 50 and 64*a*. Then wire 50 is later re-engaged with lower cross-bar 64*a*, performing the same compound wiping motion previously described for the engagement of members 50 and 62*a*. Thus, at every phase of single pole, double throw switch operation, all contacts are made and broken with a unique, advantageous wiping action.

For this reason it will be appreciated that this switch mechanism has many of the advantages of prior art structures, but not their disadvantages. Like the prior art mechanisms discussed, this invention achieves economy and physical compactness by using wires as fixed contacts and a coil spring as a moving element. Moreover, it too achieves a contact wiping action which fights the accumulation of corrosion and dirt. But this invention does so in a way which achieves a clean, abrupt total engagement and disengagement between contacts; not the gradual and quantized engagement and disengagement which occurs when one of the contacting elements is a spring formed of multiple coils. Moreover, the sliding motion of the smooth-surfaced contact wire 50 is continuous and not subject to alternate storage and release of energy, with resultant binding, jumping and skidding as in the case of an extensible coil spring contact element. Finally, from the time of initial contact until the time of final disengagement, the point of contact, i.e., the changing point of rolling tangency between the smooth cylindrical wires 50 and 62 or 64, has a constant area, in contrast to the sudden changes in contact area which occur in the case of a coil spring contact element as the individual coils come into and out of contact.

The illustrated embodiment of the invention, while presently preferred, is only one example of the many ways in which its basic concept can be carried out. Therefore it should not be considered to limit the generality of the following claims.

What is claimed is:

1. In an electrical switch mechanism of the type having support means, at least one movable contact assembly including a spring member which extends generally in a longitudinal direction and is flexible in a direction transverse to said longitudinal direction, one end of said spring member being affixed to said support means, an actuator movably mounted relative to said support means and coupled to said movable contact assembly in a manner to flex said spring member in said transverse direction upon movement of said actuator, and at least one contact member fixedly mounted upon said support means, the improvement wherein said movable contact assembly also includes a relatively stiff, smooth-surfaced movable contact member for translation in said transverse direction upon flexure of said spring member in response to the movement of said actuator, said movable contact assembly being so arranged that a portion of said movable contact member projects away from said spring member and is positioned so that said translation thereof is limited by said fixed contact member whereby electrical contact therebetween occurs as a result of said translation of said movable contact member, said actuator and said spring member have respective ranges of motion continuing after said movable contact member reaches its limit position, whereby further motion of said actuator and said spring member causes rotation of said movable contact member about said fixed contact member as a fulcrum, the surface of said fixed contact member which engages said movable contact member during said electrical contact therebetween is curved in the plane of said translation of said movable contact member whereby to permit a rolling contact motion of said movable contact member over said curved surface of said fixed contact member upon travel of said actuator past the limit position of said movable contact member.

2. A switch mechanism as in claim 1 wherein said spring member is a coil and said movable contact member is a stiff length of metal wire part of which is received within the interior of said coil.

3. In an electrical switch mechanism of the type having support means, at least one movable contact assembly including a spring member which extends generally in a longitudinal direction and is flexible in a direction transverse to said longitudinal direction, one end of said spring member being affixed to said support means, an actuator movably mounted relative to said support means and coupled to said movable contact assembly in a manner to flex said spring member in said transverse direction upon movement of said actuator, at least one contact member fixedly mounted upon said support means, said movable contact assembly also including a relatively stiff, smooth-surfaced movable contact member mounted upon the other end of said spring member for translation in said transverse direction upon flexure of said spring member in response to the movement of said actuator, said movable contact assembly being so arranged that a portion of said movable contact member projects away from said spring member and is positioned so that said translation thereof is limited by said fixed contact member whereby electrical contact therebetween occurs as a result of said translation of said movable contact member, the improvement wherein said spring member is a coil and said movable contact member is a stiff length of metal wire part of which is received within the interior of said coil.

4. A switch mechanism as in claim 3 wherein said actuator is formed with means loosely receiving said movable contact member in a manner to achieve transverse coupling, and longitudinal and rotational decoupling, between said actuator and said movable contact member.

5. In an electrical switch mechanism of the type having support means, at least one movable contact assembly including a spring member which extends generally in a longitudinal direction and is flexible in a direction transverse to said longitudinal direction, one end of said spring member being affixed to said support means, an actuator movably mounted relative to said support means and coupled to said movable contact assembly in a manner to flex said spring member in said transverse direction upon movement of said actuator, and at least one contact member fixedly mounted upon said support means, said movable contact assembly also including a relatively stiff, smooth-surfaced movable contact member mounted upon the other end of said spring member for translation in said transverse direction upon flexure of said spring member in response to the movement of said actuator, said movable contact assembly being so arranged that a portion of said movable contact member projects away from said spring member and is positioned so that said translation thereof is limited by said fixed contact member whereby electrical contact therebetween occurs as a result of said translation of said movable contact member, the improvement wherein said switch mechanism is of the double throw type, further comprising a second fized contact member, said fixed contact members being located to intercept the translational motion of said movable contact member and to define the respective opposite limits thereof.

6. A switch mechanism as in claim 5 wherein said support means comprises a base, and first and second frame members mounted on said base and displaced from each other in said longitudinal direction, said one end of said spring member being secured to said first frame, said second frame being adjacent to said movable contact member, and said fixed contact member being mounted on said second frame.

* * * * *